US005285908A

United States Patent [19]

Rogers

[11] Patent Number: 5,285,908

[45] Date of Patent: Feb. 15, 1994

[54] FLEXIBLE DISPLAY

[76] Inventor: Jerrel D. Rogers, 1317 NE. 20th Pl., Moore, Okla. 73160

[21] Appl. No.: 987,228

[22] Filed: Dec. 8, 1992

[51] Int. Cl.[5] ..... A47F 5/00

[52] U.S. Cl. ..... 211/118; 211/71; 211/117; 248/328

[58] Field of Search ..... 211/71, 113, 117, 118, 211/119; 248/317, 328

[56] References Cited

U.S. PATENT DOCUMENTS

| | | | |
|---|---|---|---|
| 1,231,544 | 6/1917 | Brown | 211/117 X |
| 3,709,453 | 1/1973 | Castiglioni | 248/328 |
| 4,034,865 | 7/1977 | Batts et al. | 211/113 X |
| 4,903,846 | 2/1990 | Smith | 211/118 X |
| 5,067,621 | 11/1991 | Alexander | 211/117 |

OTHER PUBLICATIONS

Exhibit A—A plastic strip of material having a plurality of tabs.

*Primary Examiner*—Robert W. Gibson, Jr.
*Attorney, Agent, or Firm*—Dunlap, Codding & Lee

[57] ABSTRACT

A flexible display for removably supporting containers. The flexible display comprises a string and a plurality of clip elements. Each of the clip elements is removably connectable to the string and has a container support for removably connecting the containers to the string.

28 Claims, 1 Drawing Sheet

FLEXIBLE DISPLAY

FIELD OF THE INVENTION

A flexible display for supporting containers comprising a string and a plurality of clip elements where in each clip element is removably connectable to the string and the containers are removably connectable to the clip elements.

DESCRIPTION OF THE PREFERRED EMBODIMENTS

Figure 1:
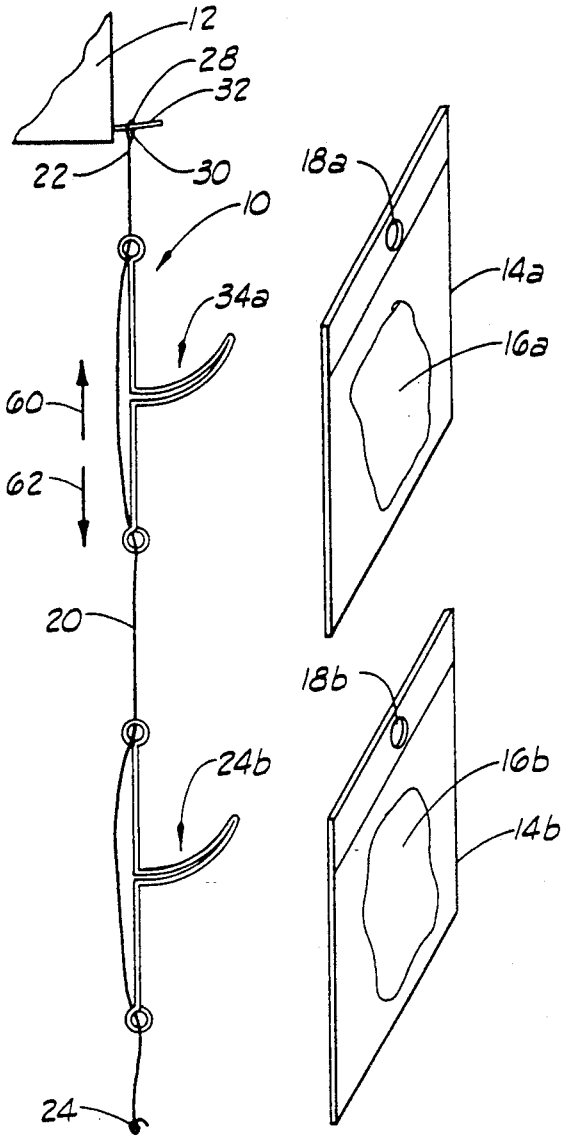
FIG. 1 is an elevational view of a flexible display constructed in accordance with the present invention removably connected to a support structure (partially shown in FIG. 1).

Shown in FIG. 1 is a flexible display 10 constructed in accordance with the present invention. As shown in FIG. 1, the flexible display 10 is removably connected to a support structure 12 (partially shown in FIG. 1) which may be a stand or a wall or any such support capable of supporting the flexible display in an extended position as shown in FIG. 1.

The flexible display 10 is adapted to removably support a plurality of containers, two containers being diagrammatically illustrated in FIG. 1 and designated therein by the reference numerals 14*a* and 14*b*. Each of the containers 14*a* and 14*b* are adapted to contain and retain saleable items which are disposed in the containers 14*a* and 14*b*, a disposable item 16*a* being shown in FIG. 1 disposed in the container 14*a* and the saleable item 16*b* being shown in FIG. 1 disposed in the container 14*b*.

Items intended to be sold are commonly disposed in plastic bags or plastic containers (shrink wrapped about the item for example) and such containers with saleable items disposed therein are commonly available and well known in the art. The saleable items 16*a* and 16*b* are illustrated in FIG. 1 to indicate any type of saleable item. The present invention is not limited to any particular type of container or any particular type of saleable item.

The containers 14 as illustrated in FIG. 1, include a container opening formed through the container 14, the container openings being illustrated in FIG. 1 and designated by the respective reference numerals 18*a* and 18*b* in the respective containers 14*a* and 14*b*.

Figure 3:
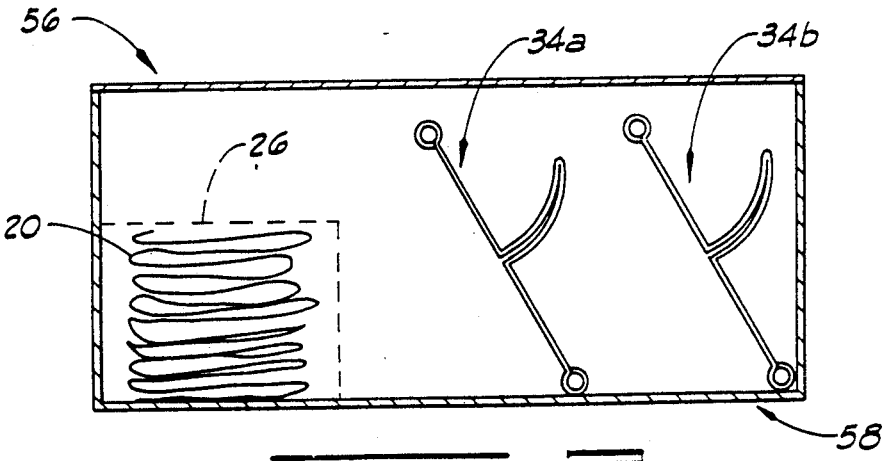
FIG. 3 is a sectional view of a kit containing a string and a plurality of clip elements in a disconnected condition for constructing a flexible display.

The flexible display 10 comprises a string 20 having a first end 22 and a second end 24. The string 20 is constructed of a flexible material such that the string 20 is foldable into a folded or wadded condition (illustrated in FIG. 3). In the folded or wadded condition, the string 20 occupies a folded volume 26 (illustrated in FIG. 3) of less than 216 cubic inches and preferably less than 64 cubic inches. The folded volume as used herein merely is intended to describe the foldable nature of the string 20 and to distinguish the flexible nature of the string 20 as opposed to a plastic or metal strip which is flexible and foldable, but not foldable and waddable into a foldable condition as illustrated in FIG. 3 and then extendable to an extended position as illustrated in FIG. 1. To further distinguish the flexible, foldable nature of the string 20, the string 20 is described herein as being foldable without causing permanent deformation of the string 20 to further distinguish the string 20 from metal strips or plastic strips which may be flexible and even foldable but where such bending or folding causes deformation. The string 20 can be constructed of any material commonly used to manufacture or make cords or string-like elements.

Figure 4:
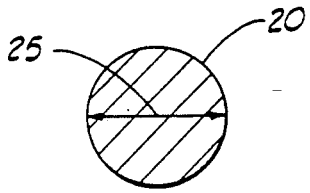
FIG. 4 is a cross-sectional view of the string shown in FIG. 1.

The string 20 has a circularly shaped cross-section, as shown in FIG. 4, although the string 20 could be square-shaped or rectangular-shaped or have any other cross-sectioned desired. The string 20 has a diameter 25 (FIG. 4). The string 20 has a cross-sectional area less than 1.0 square inches.

As shown in FIG. 1, a loop 28 is formed on the first end 22 of the string 20. The loop 28 may be formed from a portion of the string 20 near the first end 22. As an alternative, the loop 28 can be a separate element and then connected to the first end 22 of the string 20.

The loop 28 has a loop opening 30 (FIG. 1) which is sized to receive a pin 32 connected to the support structure 12. In operation, the string 20 is positioned with respect to the support structure 12 and the pin 32 is extended through the loop opening 30 of the loop 28 thereby connecting the first end 22 of the string 20 to the support structure 12. In this position, the string 20 is extended from the support structure 12 to an extended position, as illustrated in FIG. 1 where the string 20 extends in a substantially linear path.

Figure 2:
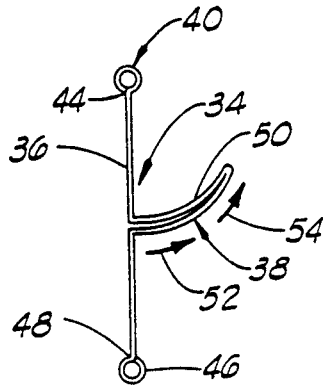
FIG. 2 is an enlarged view of a typical clip element used with the flexible display shown in FIG. 1.

The flexible display 10 includes a plurality of clip elements 34 (two clip elements 34 being illustrated in FIGS. 1, 2 and 3 and designated therein by the respective reference numerals 34*a* and 34*b*. A typical clip element 34 is illustrated in FIG. 2.

Each clip element 34 comprises a clip base 36 (FIG. 2) having a container support 38 (FIG. 2) connected thereto and a string connector 40 connected thereto. The containers support 38 is removably connectable to one of the containers 14 and the string connector 40 is removably connectable to the string 20. Each clip element 34 is connectable to the string 20 via the string connector 40 and each container 14 is removably connectable to the container support 38 of one of the clip elements 34 whereby each container 14 is removably connected to the string 20 via one of the clip elements 34 in an extended position of the string 20 supported on the support structure 12.

Shown in FIG. 2, the string connector 40 on each of the clip elements 34 more particularly includes a first clip loop 42 connected to an upper end 44 of the clip base 36 and a second clip loop 46 connected to a lower end 48 of the clip base 36. The first and the second clip loops 42 and 46 each are circularly shaped. The first and the second clip loops 42 and 46 each extend in a plane substantially coplanar with the planar disposition of the clip base 36.

As shown in FIG. 2, the container support 38 of each of the clip elements 34 more particularly comprises a hook 50 having one end connected to the clip base 36 with the hook 50 extending a distance along a substantially arcuate path from the clip base 36 a first distance in the outwardly direction 52 from the clip base 36 and extending the second distance in an upwardly direction 54 from the clip base 36.

In a preferred form, each clip element 34 is constructed of a single piece of wire with the first and the second clip loops 42 and 46 being formed on opposite ends of the wire and the hook 50 being formed by the wire generally midway between the first and the second ends of clip base 36.

The flexible display 10 is adapted to be sold in the form of a kit 56 as illustrated in FIG. 3. In this form, the string 20 and the plurality of clip elements 34 are disposed in a box 58 where such elements are retained until it is desired to use the string 28 and the clip elements 34 to support containers 14.

In operation, the string 20 is removed from the box 56 and the pin 32 is extended through the loop opening 30 on the first end of 22 of the string 20. The string 20 then is permitted to extend from the support structure 12 in an extended position, as illustrated in FIG. 1.

The clip elements 34 then are connected to the string 20. To connect the clip elements 34 to the string 20, the string 30 is extended through the first clip loop 42 and then through the second clip loop 46 of each of the clip elements 34 and the clip elements 34 are positioned in the desired position on the string 20 by sliding the clip element 34 in an upwardly direction 60 (FIG. 1) or downwardly direction 62 (FIG. 1) on the string 20. Each of the clip elements 34 is slidably movable on the string 20 via the connection between the clip loops 42 and 46 and the string 20. Each of the clip elements 34 will remain in the desired position on the string 20 via the tension or force exerted between the string 20 and the clip loops 42 and 46 since the clip loops 42 and 46 extend in a plane substantially coplanar with a planar disposition of the clip base 36, as opposed to the clip elements 42 and 46 extending perpendicularly from the clip base 36 which would result in the clip elements 34 merely sliding off the string 20.

Changes may be made in the construction of the operation of the various components, elements and assemblies described herein without departing from the spirit and the scope of the invention as defined in the following claims.

What is claimed is:

1. A flexible display for removably supporting a plurality of containers having saleable items disposed therein wherein the flexible display is supportable from a support structure, comprising:

a string having a first end and a second end and being constructed of a flexible material whereby the string is foldable to a folded condition and extendable to an extended position, the first end of the string being connectable to the support structure and the string extending from the support structure in an extended position of the string; and a plurality clip elements each clip element comprising:

a clip base having a container support connected thereto and having a string connector connected thereto, the container support being removably connectable to at least one of the containers and the string connector being connectable to the string; and wherein each clip element is connectable to the string via the string connector and each container is removably connectable to the container support of one of the clip elements so that each container is removably connected to the string via one of the clip elements in the extended position of the string.

2. The flexible display of claim 1 wherein the string connector on each of the clip bases is defined further as being removably connectable to the string.

3. The flexible display of claim 1 wherein the string is defined further as having a cross-sectional area of less than 1.0 square inches.

4. The flexible container of claim 1 wherein the string is defined further as having a foldable volume of less than 216 cubic inches in a folded condition of the string.

5. The flexible display of claim 1 wherein the string is defined further as having a folded volume of less than 64 square inches of a folded condition.

6. The flexible display of claim 1 wherein the string is defined further to include a string loop connected to the first end of the string having a loop opening formed therethrough, the string being removably connectable to the support structure via the string loop.

7. The flexible display of claim 1 wherein the string is defined further as having a cross-section shape consisting of a circle, a square or a rectangle, and wherein the string is defined further as having a cross-sectional area of less than 1 square inch.

8. The flexible display of claim 1 wherein each clip element is defined further as comprising:

a clip base having a upper end and a lower end;

a first clip loop connected to the upper end of the clip base; and a second clip loop connected to the lower end of the clip base, the string being extendable through the first and the second clip loops for removably connecting each clip element to the string.

9. The flexible display of claim 8 wherein the first clip loop and the second clip loop each are defined further as extending in a plane substantially coplanar with a planar disposition of the clip base.

10. The flexible display of claim 8 wherein the container support on each clip element defined further as comprising a hook having one end connected to the clip base with the hook extending a distance from the clip base, each of the saleable items being removably connectable to the clip element via the hook.

11. The flexible display of claim 10 wherein the hook of each clip element is defined further as extending a first distance generally outwardly from the hook base and extending a second distance generally upwardly.

12. The flexible display of claim 11 wherein the first and the second clip loops, the clip base and the hook of each clip element is defined further as being constructed from a single piece of wire.

13. The flexible display of claim 1 wherein the string is defined further as extending in a substantially linear path in an extended position of the string.

14. The flexible display of claim 1 wherein the string is defined further as being foldable to the folded condition without causing permanent deformation in the string.

15. A kit for retaining a flexible display wherein the flexible display is adapted to removably support a plurality of containers having saleable items disposed therein wherein the flexible display is supportable from a support structure, comprising:

a box;

a string disposed in the box;

a string having a first end and a second end and being constructed of a flexible material whereby the string is foldable to a folded condition and extendable to an extended position, the first end of the string being connectable to the support structure and the string extending from the support structure in an extended position of the string; and a plurality clip elements each clip element comprising:

a clip base having a container support connected thereto and having a string connector connected thereto, the container support being removably connectable to at least one of the containers and the string connector being connectable to the string; and wherein each clip element is connectable to the string via the string connector and each container is removably connectable to the container support of one of the clip elements so that each container is removably connected to the string via one of the clip elements in the extended position of the string, the string being folded to the folded condition when disposed in the box.

16. The kit of claim 15 wherein the string connector on each of the clip bases is defined further as being removably connectable to the string.

17. The kit of claim 15 wherein the string is defined further as having a cross-sectional area of less than 1.0 square inches.

18. The kit of claim 15 wherein the string is defined further as having a foldable volume of less than 216 cubic inches in a folded condition of the string.

19. The kit of claim 15 wherein the string is defined further as having a folded volume of less than 64 square inches of a folded condition.

20. The kit of claim 15 wherein the string is defined further to include a string loop connected to the first end of the string having a loop opening formed therethrough, the string being removably connectable to the support structure via the string loop.

21. The kit of claim 15 wherein the string is defined further as having a cross-section shape consisting of a circle, a square or a rectangle, and wherein the string is defined further as having a cross-sectional area of less than 1 square inch.

22. The kit of claim 15 wherein each clip element is defined further as comprising:

a clip base having a upper end and a lower end;

a first clip loop connected to the upper end of the clip base; and a second clip loop connected to the lower end of the clip base, the string being extendable through the first and the second clip loops for removably connecting each clip element to the string.

23. The kit of claim 22 wherein the first clip loop and the second clip loop each are defined further as extending in a plane substantially coplanar with a planar disposition of the clip base.

24. The kit of claim 22 wherein the container support on each clip element defined further as comprising a hook having one end connected to the clip base with the hook extending a distance from the clip base, each of the saleable items being removably connectable to the clip element via the hook.

25. The kit of claim 24 wherein the hook of each clip element is defined further as extending a first distance generally outwardly from the hook base and extending a second distance generally upwardly.

26. The kit of claim 25 wherein the first and the second clip loops, the clip base and the hook of each clip element is defined further as being constructed from a single piece of wire.

27. The flexible display of claim 15 wherein the string is defined further as extending in a substantially linear path in an extended position of the string.

28. The flexible display of claim 15 wherein the string is defined further as being foldable to the folded condition without causing permanent deformation in the string.

* * * * *